US012313259B2

(12) United States Patent
Nagasaka

(10) Patent No.: US 12,313,259 B2
(45) Date of Patent: May 27, 2025

(54) COMBUSTION APPARATUS

(71) Applicant: RINNAI CORPORATION, Aichi (JP)

(72) Inventor: Toshimitsu Nagasaka, Aichi (JP)

(73) Assignee: RINNAI CORPORATION, Aichi (JP)

( * ) Notice: Subject to any disclaimer, the term of this patent is extended or adjusted under 35 U.S.C. 154(b) by 412 days.

(21) Appl. No.: 18/054,696

(22) Filed: Nov. 11, 2022

(65) Prior Publication Data

US 2023/0175691 A1 Jun. 8, 2023

(30) Foreign Application Priority Data

Dec. 2, 2021 (JP) ..... 2021-195935

(51) Int. Cl.

| | |
|---|---|
| ***F23M 5/04*** | (2006.01) |
| ***F24H 1/00*** | (2022.01) |
| ***F24H 1/14*** | (2022.01) |
| ***F24H 1/40*** | (2022.01) |
| ***F24H 9/02*** | (2006.01) |
| *F24H 9/1832* | (2022.01) |

(52) U.S. Cl.

CPC ..... *F23M 5/04* (2013.01); *F24H 1/145* (2013.01); *F24H 9/02* (2013.01); *F24H 1/0027* (2013.01); *F24H 1/40* (2013.01); *F24H 9/1832* (2022.01)

(58) Field of Classification Search

CPC ..... F24H 1/145; F24H 9/02; F24H 1/0027; F24H 1/40; F24H 9/1832; F23M 5/04

See application file for complete search history.

(56) References Cited

FOREIGN PATENT DOCUMENTS

| | | | | |
|---|---|---|---|---|
| JP | 2017-207259 | | 11/2017 | |
| KR | 20200137829 | A * | 12/2020 | |
| WO | WO-2006041244 | A1 * | 4/2006 | ..... F28D 7/0066 |

OTHER PUBLICATIONS

KR-20200137829-A translation (Year: 2020).*

* cited by examiner

*Primary Examiner* — Steven S Anderson, II

*Assistant Examiner* — Kurt J Wolford

(74) *Attorney, Agent, or Firm* — Future IP LLC; Tomoko Nakajima

(57) ABSTRACT

A thermal insulation material is arranged on an inner surface of a swelling part formed at a side plate part and outwardly swelling in an X-axis direction so as to be sandwiched from both sides in a Z-axis direction by a step outwardly bent in the X-axis direction and positioned an end, in a Z-axis plus direction, of the swelling part and by a structural member of a burner protruding inwardly in the X-axis direction from an end, in the Z-axis minus direction, of the side plate part. A vicinity portion of an end, in the Z-axis plus direction, of the thermal insulation material is held from an inside in the X-axis direction by a side edge portion, on each side in the X-axis direction, of the fins.

4 Claims, 4 Drawing Sheets

COMBUSTION APPARATUS

TECHNICAL FIELD

The invention relates to a combustion apparatus with which a burner, a combustion box that encloses a combustion space of an air-fuel mixture that ejects from the burner, and a fin-tube type of a heat exchanger that is disposed in the combustion box and has a plurality of fins which are arranged in parallel, and a plurality of heat absorbing tubes which pierce the fins, are provided.

BACKGROUND ART

In a conventional combustion apparatus, water tubes that are connected to the heat exchanger are wound around a portion of the combustion box between the burner and the heat exchanger, and thereby occurrence of overheat at the portion in question of the combustion box due to heat by combustion of the air-fuel mixture has been prevented. See patent document No. 1, for example. However, winging of the water tubes around the combustion box leads to high cost.

Additionally, it has been considered that by mounting a thermal insulation material on an inner surface of the portion of the combustion box between the burner and the heat exchanger, the overheat at the portion in question of the combustion box is prevented. According to this manner, cost reduction can be promoted compared with the former conventional combustion apparatus in which the water tubes are wound around the combustion box. Here, in order to prevent the thermal insulation material from falling off, it is general that the thermal insulation material is mounted on the inner surface of the combustion box by using such a member dedicated to anti-falling as a metal fitting. However, thereby, an effect of cost reduction is lost.

REFERENCE

Patent document No. 1: JPA 2017-207259

SUMMARY OF INVENTION

Technical Problems

In the light of the above-mentioned problem, the invention provides a combustion apparatus that can prevent overheat at a portion of a combustion box between a burner and a heat exchanger and reduce cost as much as possible.

Solution to Problems

In order to solve the above-mentioned problems, the invention presupposes a combustion apparatus includes: a burner; a combustion box that encloses a combustion space of an air-fuel mixture which ejects from the burner; and a fin-tube type of a heat exchanger that is disposed in the combustion box and has a plurality of fins which are arranged in parallel, and a plurality of heat absorbing tubes which pierce the fins. On a premise that an opposite direction of the burner to the heat exchanger is defined as a Z axis-direction, a direction from the burner to the heat exchanger is defined as a Z-axis plus direction, a direction from the heat exchanger to the burner is defined as a Z-axis minus direction, an arranged direction of the fins is defined as a Y-axis direction, and an orthogonal direction to the Z-axis and Y-axis directions is defined as an X-axis direction, in the combustion apparatus, on an inner surface of a side plate part, on each side in the X-axis direction, of the combustion box, a first thermal insulation material that is positioned between the burner and the heat exchanger is mounted. Further, in the combustion apparatus, at the side plate part, on each side in the X-axis direction, of the combustion box, a first swelling part that ranges from a Z-axis direction position which coincides with a potion that is distant at a predetermined distance in the Z-axis plus direction from an end, in the Z-axis minus direction, of a side edge portion, on each side in X-axis direction, of the fins, which is parallel to the Z-axis direction, to an end, in the Z-axis minus direction, of the side plate part on each side in the X-axis direction, and that outwardly swells in the X-axis direction beyond a disposition part of the heat exchanger is formed; and on an inner surface of the first swelling part, the first thermal insulation material is mounted so as to be sandwiched from both sides in the Z-axis direction by a step that is outwardly bent in the X-axis direction, which is positioned at an end, in the Z-axis plus direction, of the first swelling part and a structural member of the burner, which inwardly protrudes in the X-axis direction from the end, in the Z-axis minus direction, of the side plate part on each side in the X-axis direction, and a vicinity portion of an end, in the Z-axis plus direction, of the first thermal insulation material is held from an inside in the X-axis direction by the side edge portion on each side, in the X-axis direction, of the fin, which is parallel to the Z-axis direction.

According to the invention, on the inner surface of the first swelling part that is formed at the side plate part, on each side in the X-axis direction, of the combustion box, the first heat insulation material can be mounted using the burner structural member and the fins of the heat exchanger so as to prevent falling of the first thermal insulation material. Accordingly, any of especial members dedicated to anti-falling of the first thermal insulation material is unnecessary. As a result, overheat at a portion of the side plate part, on each side in the X-axis direction, of the combustion box, which is positioned between the burner and the heat exchanger, can be prevented and cost can be also reduced as much as possible.

In the invention, it is desirable that in a case where, on the inner surface of a side plate part, on each side in the Y-axis direction, of the combustion box, a second thermal insulation material that is positioned between the burner and the heat exchanger is mounted, at the side plate part, on each side in the Y-axis direction, of the combustion box, a second swelling part that ranges from a Z-axis direction position which coincides with a vicinity of an end, in the Z-axis minus direction, of the fin that is positioned at an outmost side, in the Y-axis direction, of the heat exchanger to an end, in the Z-axis minus direction, of the side plate part on each side in the Y-axis direction and that outwardly swells in the Y-axis direction beyond the disposition portion of the heat exchanger is arranged; on an inner surface of the second swelling part, a second thermal insulation material is mounted so as to be sandwiched from both sides in the Z-axis direction by a step that is outwardly bent in the Y-axis direction, which is positioned at an end, in the Z-axis plus direction, of the second swelling part and a burner structural member, which inwardly protrudes in the Y-axis direction from an end, in the Z-axis minus direction, of the side plate part on each side in the Y-direction; a vicinity portion of an end edge, on each side in the X-axis direction, of the second thermal insulation material is inserted into an end portion, in the Y-axis direction, of the first swelling part of the side plate part, on each side in the X-axis direction, of the combustion box; and the vicinity portion of the end edge, on each side in the X-axis direction, of the second thermal insulation material is held from an inside in the Y-axis direction by an end edge, on each side in the Y-axis direction, of the first thermal insulation material. According to the above-mentioned structure, on the inner surface of the second swelling part, the second thermal insulation material can be mounted using the burner structural member and the first thermal insulation material so as to prevent falling of the second thermal insulation material. Accordingly, any of especial members dedicated to anti-falling of the second thermal insulation material is unnecessary. As a result, overheat at a portion of the side plate part, on each side in the Y-axis direction, of the combustion box, which is positioned between the burner and the heat exchanger, can be prevented and cost can be also reduced as much as possible.

Additionally, in the invention, it is also desirable that, at the first swelling part, the second swelling part, or both, a contact portion(s) that comes into contact with an outer surface of the first thermal insulation material, the second thermal insulation material, or both and an escaping portion that outwardly swells in the X-axis direction, the Y-axis direction, or both beyond the contact portion(s) and is distant from the outer surface of the first thermal insulation material, the second thermal insulation material, or both are arranged. According to the above-mentioned structure, a heat insulating air layer(s) between the escaping portion of the first thermal insulation material, the second thermal insulation material, or both and the first thermal insulation material, the second thermal insulation material, or both is formed and thereby the overheat of the portion of the combustion box between the burner and the heat exchanger can be more effectively prevented.

DESCRIPTION OF EMBODIMENTS

Figure 1:
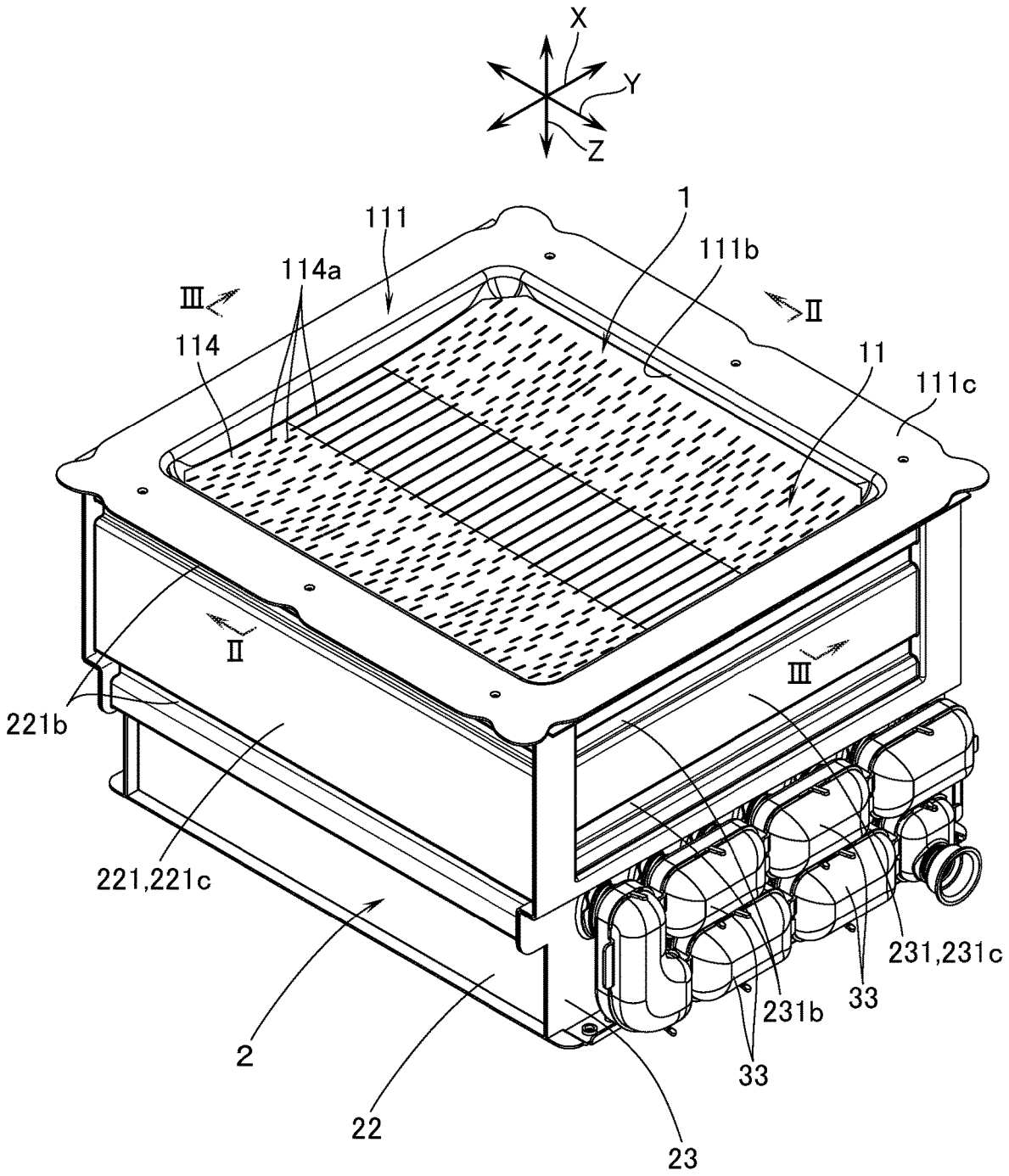
FIG. 1 is a perspective view that shows an embodiment of a combustion apparatus of the invention.
Figure 2:
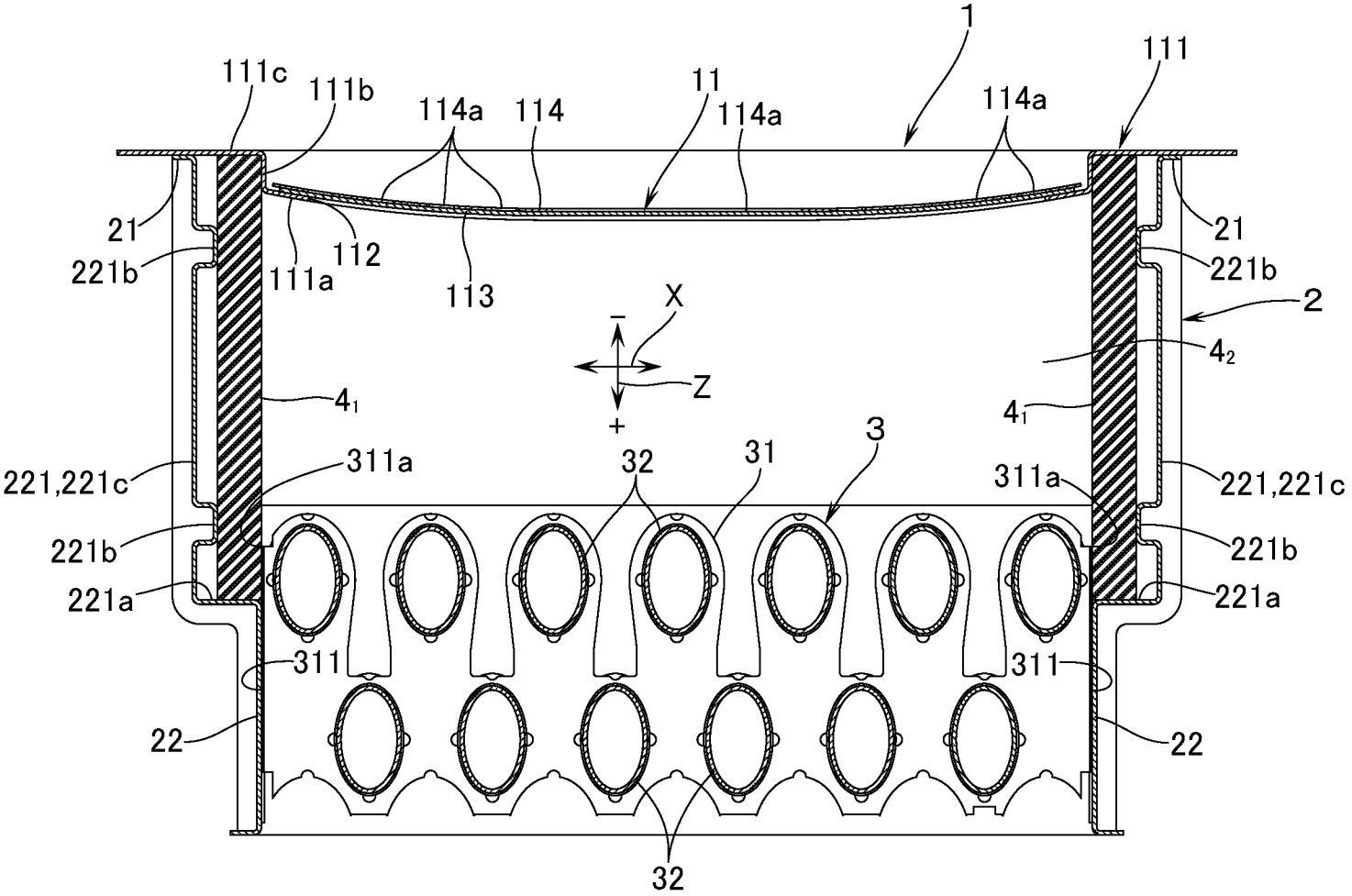
FIG. 2 is a cross section that is cut along a II-II line in FIG. 1.
Figure 3:
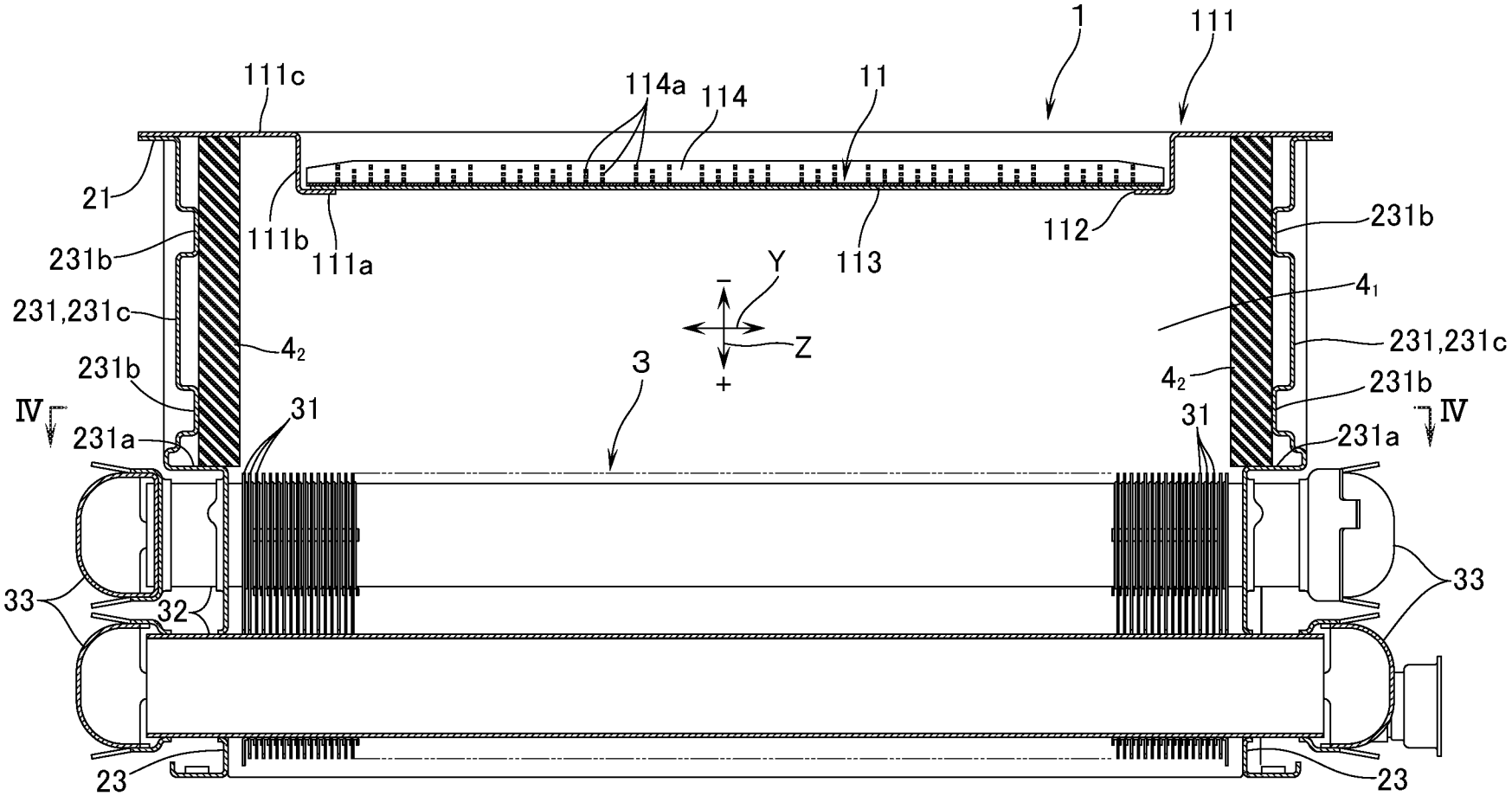
FIG. 3 is a cross section that is cut along a III-III line in FIG. 1.

A combustion apparatus of an embodiment of the invention, which is shown in FIGS. 1-3, includes a burner 1 that has a combustion plate part 11 which covers an opening plane downward of a burner body, which is not shown in the figures; a combustion box 2 that surrounds a combustion space in which an air-fuel mixture ejects from the burner 1, i.e., the combustion plate part 11; and a fin-tube type of a heat exchanger 3 that is disposed in the combustion box 2 and has a plurality of fins 31 which are arranged in parallel, and a plurality of heat absorbing tubes 32 which pierce the fins 31.

The combustion plate part 11 has a burner frame 111 of which a shape is something like a picture frame; a metal-fiber knit 113 that is arranged to cover an opening part 112, which is surrounded by the burner frame 111, from a side of the burner body (upper side); and a distribution plate 114 that is disposed by laminating on a rear surface (upper surface) of the metal-fiber knit 113 and at which a plurality of distribution pores 114*a* are formed. The air-fuel mixture that is supplied in the burner body ejects from the opening part 112 through the distribution pores 114*a* and the metal-fiber knit 113 and is combusted in totally aerated combustion (combustion unnecessary for secondary air).

The burner frame 111 has an opening periphery-part 111*a* that is positioned on a same plane as the opening part 112, a squeezed part 111*b* that bends from the opening periphery-part 111*a* to the burner body side (upward), a frame-flange part 111*c* that outwardly protrudes from an upper end of the squeezed part 111*b*. The combustion plate part 11 is assembled, in a state where the distribution plate 114 is laminated on the rear surface of the metal-fiber knit 113, by spot-welding of a peripheral portion of such a composite as the distribution plate 114 and the metal-fiber knit 113 to the opening peripheral-part 111*a* of the burner frame 111 at a fixed interval. The frame-flange part 111*c* seats on an upper surface of a box-flange part 21 that is arranged at an upper end of the combustion box 2 and outwardly protrudes is fastened to the box-flange part 21.

Now, the combustion box 2 will be explained in detail on a premise that an opposite direction to the burner 1 and the heat exchanger 3 is defined as a Z-axis direction, a direction from the burner 1 to the heat exchanger 3 is defined as a Z-axis plus direction (downward in the embodiment), a direction from the heat exchanger 3 to the burner 1 is defined as a Z-axis minus direction (upward in the embodiment), an aliened direction of the fins 31 of the heat exchanger 3 is defined as a Y-axis direction, and an orthogonal direction to the Z-axis and Y-axis directions is defined as an X-axis direction.

The combustion box 2 has side plate parts 22 and 22 on both sides in the X-axis direction and side plate parts 23 and 23 on both sides in the Y-axis direction. At an end, in the Z-axis minus direction, of each of the side plate parts 22 and 23, the above-mentioned box-flange part 21 is arranged. Additionally, at outsides of the side plate parts 23 and 23, on both sides in the Y-axis direction, of the combustion box 2, a plurality of connecting tube parts 33 that connects two adjacent heat absorbing tubes 32 and 32 of the heat exchanger 3 to each other are arranged. Then, all of the heat absorbing tubes 32 are connected in series.

On an inner surface of the side plate part 22, on each side in the X-axis direction, of the combustion box 2, a first thermal insulation material $\mathbf{4}_1$ that is positioned between the burner 1 and the heat exchanger 3 is mounted. Similarly, on an inner surface of the side plate part 23, on each side in the Y-axis direction, of the combustion box 2, a second thermal insulation material $\mathbf{4}_2$ that is positioned between the burner 1 and the heat exchanger 3 is mounted.

Here, at the side plate part 22, on each side in the X-axis direction, of the combustion box 2, a first swelling part 221 that ranges from a Z-axis direction position which coincides with a potion that is distant at a predetermined distance in the Z-axis plus direction from an end 311*a*, in the Z-axis minus direction, of a side edge portion 311, on each side in X-axis direction, of the fins 31 of the heat exchanger 3, which is parallel to the Z-axis direction, to an end, in the Z-axis minus direction, of the side plate part 22, and outwardly swells in the X-axis direction beyond a disposition part of the heat exchanger 3 is formed. Then, on an inner surface of the first swelling part 221, a first thermal insulation material $\mathbf{4}_1$ is mounted so as to be sandwiched from both sides in the Z-axis direction by a step 221*a* that is outwardly bent in the X-axis direction, which is positioned at an end, in the Z-axis plus direction, of the first swelling part 221 and a structural member of the burner 1, i.e., the burner frame 111, which inwardly protrudes in the X-axis direction from an end, in the Z-axis minus direction, of the side plate part 22 on each side in the X-axis direction. Further, a vicinity portion of an end, in the Z-axis plus direction, of the first thermal insulation material $\mathbf{4}_1$ is held from an inside in the X-axis direction by the side edge portion 311 on each side, in the X-axis direction, of each of the fins 31, which is parallel to the Z-axis direction. Additionally, in the embodiment, a vicinity portion of an end, in the Z-axis minus direction, of the first thermal insulation material $\mathbf{4}_1$ is also held from the inside in the X-axis direction by the squeezed part 111*b*, on each side in the X-axis direction, of the burner frame 111.

According to the above-mentioned structure, on the inner surface of each of the first swelling parts 221, the first thermal insulation material $\mathbf{4}_1$ can be amounted using the burner frame 111 and fins 31 of the heat exchanger 3 so as to prevent falling of the first thermal insulation material $\mathbf{4}_1$. Accordingly, any of especial members dedicated to anti-falling of the first thermal insulation material $\mathbf{4}_1$ is unnecessary. As a result, overheat at a portion of the side plate part 22, on each side in the X-axis direction, of the combustion box 2, which is positioned between the burner 1 and the heat exchanger 3, can be prevented and cost can be also reduced as much as possible.

Figure 4:
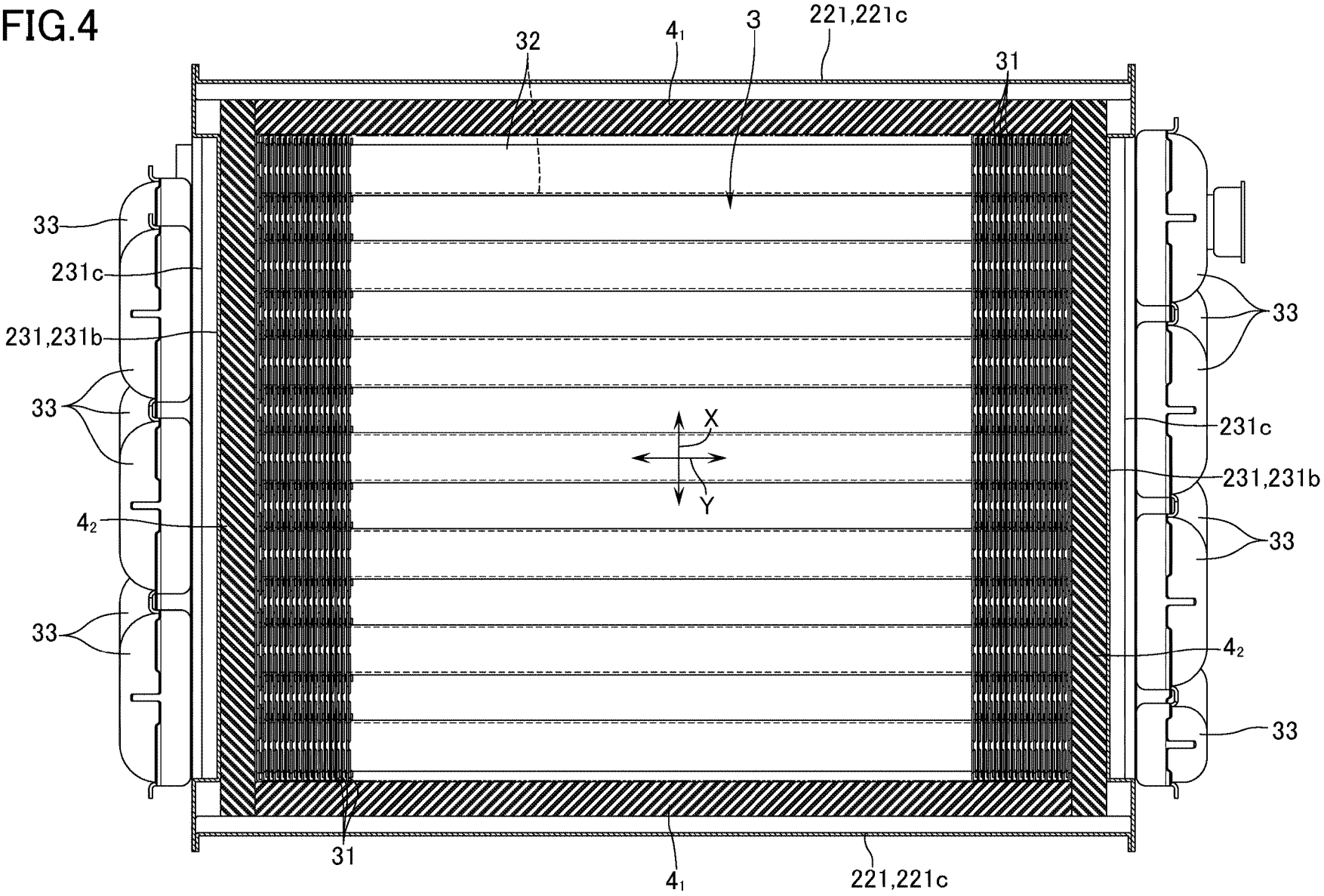
FIG. 4 is a cut plane view that is cut along a IV-IV line in FIG. 3.

Additionally, at the side plate part 23, on each side in the Y-axis direction, of the combustion box 2, a second swelling part 231 that ranges from a Z-axis direction position that coincides with a vicinity of the end, in the Z-axis minus direction, of the fin 31 which is positioned at an outmost side, in the Y-axis direction, of the heat exchanger 3 to an end, in the Z-axis minus direction, of the side plate part 23 on each side in the Y-axis direction and that outwardly swells in the Y-axis direction beyond the disposition portion of the heat exchanger 3. Then, on an inner surface of the second swelling part 231, a second thermal insulation material $\mathbf{4}_2$ is mounted so as to be sandwiched from both sides in the Z-axis direction by a step 231*a* that is outwardly bent in the Y-axis direction, which is positioned at an end, in the Z-axis plus direction, of the second swelling part 231 and the burner frame 111 as a burner structural member, which inwardly protrudes in the Y-axis direction from an end, in the Z-axis minus direction, of the side plate part 23 on each side in the Y-direction. Further, as shown in FIG. 4, a vicinity portion of an end edge, on each side in the X-axis direction, of the second thermal insulation material $\mathbf{4}_2$ is inserted into an end portion, in the Y-axis direction, of the first swelling part 221 of the side plate part 22, on each side in the X-axis direction, of the combustion box 2. Then, the vicinity portion of the end edge, on each side in the X-axis direction, of the second thermal insulation material $\mathbf{4}_2$ is held from an inside in the Y-axis direction by an end edge, on each side in the Y-axis direction, of the first thermal insulation material $\mathbf{4}_1$.

According to the above-mentioned structure, on the inner surface of the second swelling part 231, the second thermal insulation material $\mathbf{4}_2$ can be mounted using the burner frame 111 and the first thermal insulation material $\mathbf{4}_1$ so as to prevent falling of the second thermal insulation material $\mathbf{4}_2$. Accordingly, any of especial members dedicated to anti-falling of the second thermal insulation material $\mathbf{4}_2$ is unnecessary. As a result, overheat at a portion of the side plate part 23, on each side in the Y-axis direction, of the combustion box 2, which is positioned between the burner 1 and the heat exchanger 3, can be prevented and cost can be also reduced as much as possible.

Additionally, in the embodiment, at each of the first and second swelling parts 221, 231, contact portions 221*b*, 231*b* that come in contact with an outer surface of each of the first and second thermal insulation materials $\mathbf{4}_1$, $\mathbf{4}_2$, and escaping portions 221*c*, 231*c* that outwardly swell in the X-axis and Y-axis directions beyond the contact portions 221*b*, 231*b* and are distant from the outer surface of each of the first and second thermal insulation materials $\mathbf{4}_1$, $\mathbf{4}_2$ are arranged. Incidentally, the contact portions 221*b*, 231*b* of each of the first and second swelling parts 221, 231 that are disposed distant from each other in the Z-axis direction form a pair, and portions except the contact portions 221*b*, 231*b* becomes the escaping portions 221*c*, 231*c*.

By arrangement of each of the escaping portions 221*c*, 231*c* at each of the first and second swelling parts 221, 231, a heat insulating air layer between each of the escaping portions 221*c*, 231*c* and each of the first and second thermal insulation material $\mathbf{4}_1$, $\mathbf{4}_2$. Therefore, the overheat of the portion of the combustion box 2 between the burner 1 and the heat exchanger 3 can be more effectively prevented.

The embodiment of the invention is explained referring to figures in the above. On the other hand, the invention is not restricted to the above-mentioned embodiment. For example, though, in the combustion apparatus of the embodiment, the Z-axis plus direction directs downward, the invention may similarly adapt to a combustion apparatus of which the Z-axis plus direction directs upward.

EXPLANATION OF SYMBOLS

1 Burner
111 Burner frame (Structural member of Burner)
2 Combustion box
22 Side plate part on each side in X-axis direction
221 First swelling part
221*a* Step
221*b* Contact portion
221*c* Escaping portion
23 Side plate part on each side in Y-axis direction
231 Second swelling part
231*a* Difference in level
231*b* Contact portion
231*c* Escaping portion
3 Heat exchanger
31 Fin
32 Heat absorbing tube
$\mathbf{4}_1$ First thermal insulation material
$\mathbf{4}_2$ Second thermal insulation material

What is claimed is:

1. A combustion apparatus, comprising, a burner;

a combustion box that encloses a combustion space of an air-fuel mixture which ejects from the burner; and a fin-tube type of a heat exchanger that is disposed in the combustion box and has a plurality of fins which are arranged in parallel, and a plurality of heat absorbing tubes which pierce the fins, wherein, on a premise that an opposite direction of the burner to the heat exchanger is defined as a Z axis-direction, a direction from the burner to the heat exchanger is defined as a Z-axis plus direction, a direction from the heat exchanger to the burner is defined as a Z-axis minus direction, an arranged direction of the fins is defined as a Y-axis direction, and an orthogonal direction to the Z-axis and Y-axis directions is defined as an X-axis direction, on an inner surface of a side plate part, on each side in the X-axis direction, of the combustion box, a first thermal insulation material that is positioned between the burner and the heat exchanger is mounted, wherein:

at the side plate part, on each side in the X-axis direction, of the combustion box, a first swelling part that ranges from a Z-axis direction position which coincides with a position that is distant at a predetermined distance in the Z-axis plus direction from an end, in the Z-axis minus direction, of a side edge portion, on each side in X-axis direction, of the fins, which is parallel to the Z-axis direction, to an end, in the Z-axis minus direction, of the side plate part on each side in the X-axis direction, and that outwardly swells in the X-axis direction beyond a disposition part of the heat exchanger is formed; and on an inner surface of the first swelling part, the first thermal insulation material is mounted so as to be sandwiched from both sides in the Z-axis direction by a step that is outwardly bent in the X-axis direction, which is positioned at an end, in the Z-axis plus direction, of the first swelling part and a structural member of the burner, which inwardly protrudes in the X-axis direction from the end, in the Z-axis minus direction, of the side plate part on each side in the X-axis direction, and a vicinity portion of an end, in the Z-axis plus direction, of the first thermal insulation material is held from an inside in the X-axis direction by the side edge portion on each side, in the X-axis direction, of the fin, which is parallel to the Z-axis direction.

2. The combustion apparatus as claimed in claim 1, wherein, at the first swelling part, a contact portion(s) that comes into contact with an outer surface of the first thermal insulation material and an escaping portion that outwardly swells in the X-axis direction beyond the contact portion(s) and is distant from the outer surface of the first thermal insulation material are arranged.

3. The combustion apparatus as claimed in claim 1, wherein, on an inner surface of a side plate part, on each side in the Y-axis direction, of the combustion box, a second thermal insulation material that is positioned between the burner and the heat exchanger is mounted, wherein:

at the side plate part, on each side in the Y-axis direction, of the combustion box, a second swelling part that ranges from a Z-axis direction position which coincides with a vicinity of an end, in the Z-axis minus direction, of the fin that is positioned at an outmost side, in the Y-axis direction, of the heat exchanger to an end, in the Z-axis minus direction, of the side plate part on each side in the Y-axis direction and that outwardly swells in the Y-axis direction beyond the disposition portion of the heat exchanger is arranged; on an inner surface of the second swelling part, a second thermal insulation material is mounted so as to be sandwiched from both sides in the Z-axis direction by a step that is outwardly bent in the Y-axis direction, which is positioned at an end, in the Z-axis plus direction, of the second swelling part and a burner structural member, which inwardly protrudes in the Y-axis direction from an end, in the Z-axis minus direction, of the side plate part on each side in the Y-direction; a vicinity portion of an end edge, on each side in the X-axis direction, of the second thermal insulation material is inserted into an end portion, in the Y-axis direction, of the first swelling part of the side plate part, on each side in the X-axis direction, of the combustion box; and the vicinity portion of the end edge, on each side in the X-axis direction, of the second thermal insulation material is held from an inside in the Y-axis direction by an end edge, on each side in the Y-axis direction, of the first thermal insulation material.

4. The combustion apparatus as claimed in claim 3, wherein, at the second swelling part, a contact portion(s) that comes into contact with an outer surface of the second thermal insulation material and an escaping portion that outwardly swells in the X-axis direction beyond the contact portion(s) and is distant from the outer surface of the second thermal insulation material are arranged.

* * * * *